US006461077B1

(12) United States Patent
Siblik

(10) Patent No.: US 6,461,077 B1
(45) Date of Patent: Oct. 8, 2002

(54) REFLECTOR BASE

(75) Inventor: Allen D. Siblik, Wadsworth, IL (US)

(73) Assignee: Hallen Products, Ltd., Park City, IL (US)

( * ) Notice: Subject to any disclaimer, the term of this patent is extended or adjusted under 35 U.S.C. 154(b) by 0 days.

(21) Appl. No.: 09/505,701

(22) Filed: Feb. 17, 2000

(51) Int. Cl.[7] ..... E01F 11/00
(52) U.S. Cl. ..... 404/16; 404/14; 404/15
(58) Field of Search ..... 116/63 R; 249/52; 404/12, 13, 14, 15, 16, 25, 26

(56) References Cited

U.S. PATENT DOCUMENTS

| | | | | | |
|---|---|---|---|---|---|
| 1,952,942 | A | | 3/1934 | Ross | |
| 2,126,224 | A | | 8/1938 | Shaffer et al. | |
| 2,146,359 | A | | 2/1939 | Shaw | |
| 2,148,079 | A | * | 2/1939 | Martin, Jr. | 249/52 |
| 2,185,488 | A | | 1/1940 | White, Jr. | |
| 3,273,205 | A | * | 9/1966 | Hanley | 249/52 |
| 3,485,148 | A | | 12/1969 | Heenan | |
| 3,587,416 | A | | 6/1971 | Flanagan | |
| 3,717,076 | A | * | 2/1973 | Shields et al. | 94/1.5 |
| 3,790,293 | A | | 2/1974 | Heenan et al. | |
| 3,809,487 | A | | 5/1974 | Flanagan | |
| 3,975,108 | A | | 8/1976 | Suhr et al. | |
| 4,147,447 | A | | 4/1979 | Heenan et al. | |
| 4,155,666 | A | | 5/1979 | Flanagan | |
| 4,195,945 | A | | 4/1980 | Heenan | |
| 4,232,979 | A | | 11/1980 | Johnson, Jr. et al. | |
| D270,143 | S | | 8/1983 | Flanagan | |
| 4,466,219 | A | * | 8/1984 | Campolito | 52/20 |
| 4,557,624 | A | | 12/1985 | Walker | |
| 4,577,992 | A | | 3/1986 | Jefferies | |
| 4,634,310 | A | * | 1/1987 | Clarke | 404/15 |
| 4,659,248 | A | | 4/1987 | Flanagan | |
| 4,854,768 | A | | 8/1989 | Flanagan et al. | |
| 4,883,384 | A | * | 11/1989 | Hedgewick | 404/14 |
| 5,201,151 | A | * | 4/1993 | LeBlanc et al. | 52/20 |
| 5,257,875 | A | | 11/1993 | Flanagan | |
| 5,277,513 | A | | 1/1994 | Flanagan et al. | |
| 5,308,186 | A | * | 5/1994 | Hedgewick | 404/14 |
| 5,454,644 | A | * | 10/1995 | Siblik | 404/14 |
| 5,839,816 | A | * | 11/1998 | Varga et al. | 362/153.1 |
| 5,944,442 | A | * | 8/1999 | Roush et al. | 404/26 |
| 5,975,794 | A | * | 11/1999 | Hedgewick | 404/14 |
| 6,062,766 | A | * | 5/2000 | Fluery et al. | 404/11 |
| 6,102,612 | A | * | 8/2000 | Pricone et al. | 404/13 |
| 6,116,812 | A | * | 9/2000 | Hedgewick | 404/14 |
| 6,234,712 | B1 | * | 5/2001 | Flader et al. | 404/14 |

* cited by examiner

*Primary Examiner*—Thomas B. Will
*Assistant Examiner*—Raymond W Addie
(74) *Attorney, Agent, or Firm*—Barnes & Thornburg

(57) ABSTRACT

A road marker base having locators or protrusions which are frangibly connected to the base. The pair of protrusions extend horizontally from the base in opposite directions and transverse to the direction of travel and include a bottom surface for engaging the top surface of the roadway adjacent the recess. The bottom surface defines the height of the reflector support surface relative to the road's top surface. A unidirectional base includes a reflector support surface adjacent one end of the base in the direction of travel capable of receiving and providing visibility of both faces of a standard bidirectional reflector.

15 Claims, 5 Drawing Sheets

REFLECTOR BASE

BACKGROUND AND SUMMARY OF THE INVENTION

The present invention relates generally to road markers and more specifically to an improved base for a road marker which is secured in a recess of the road.

Pavement road markers generally include a base and a light source or reflector on the base. The base is mounted in a recess in the road and held thereto, for example, by epoxy. The bases usually include a reflector support surface and a series of locators or buttons extending from the lateral edge thereof. The bottom surface of the locators engages the top surface of the roadway to position the reflector support surface at a given distance below the top surface of the roadway. The locators are an integral part of the base which is generally a cast of iron material. Such a road marker is illustrated in U.S. Pat. No. 5,454,664 to Siblik.

The road marker of the Siblik Patents includes webs on the bottom to disperse liquid adhesively upwardly over the sides of the base when mounted on the pavement recess. It also includes protrusion 7 to distribute adhesive over the underside of the base when mounted in the pavement recess. Even with these provisions, sometimes additional caulking is required to totally fill the road recess after the marker has been inserted.

One of the problems experienced by all road markers is that they are damaged and/or ejected from the recess in the road surface by continual forces applied by snowplow blades or other snow removal equipment. One source of the problem are exposed edges of the base above the road. One of the first sources are the locators or buttons at the lateral side of the base. Another source is the leading edge of the base which extends above the road surface. Typically, the adhesive epoxy forms a stronger bond with the base than it does with the road. Thus, they move as a unit and the bond between the epoxy and the road is broken. Once this bond is broken, further impact from snowplows or other snow removal devices will eject the road marker from the recess in the roadway.

A road marker base according to the present invention addresses these problems by providing locators or protrusions which are frangible connected to the base. The base includes a bottom surface to be received in a recess in the road and a reflector support surface. The pair of protrusions extend horizontally from the base in opposite directions and transverse to the direction of travel and include a bottom surface for engaging the top surface of the roadway adjacent the recess. The bottom surface defines the height of the reflector support surface relative to the road's top surface. The protrusions being frangible connected to the base allow any impact received by the protrusions to separate the protrusions from the base. This removes one of the objectionable surfaces.

The frangible protrusions can be the result of the base being of a first hardness and the protrusions are of second hardness less than the first hardness. For example, the base may be made of metal and the protrusions made of non-metal, for example, wood or plastic. The base may be metal of the first hardness and the protrusions may be a metal of the second hardness less the first hardness. Also, the base may be a single unit with the protrusions and the protrusions are connected to the base by a weakened section.

In another embodiment, slots are provided in the base and protrusions are joined to the base in the slots. The protrusions may be discs or other flat elements which are received in the slot and extend horizontally therefrom. In a further embodiment, the protrusions may be an inverted L-shaped having a horizontal and a vertical leg. The vertical leg is mounted to the base and the horizontal leg has the bottom surface which defines the height of the reflector support surface relative to the road's top surface. The L-shaped protrusion may include a third leg extending from the vertical leg and engaging the bottom surface of the base. The base may include a hole and the L-shaped protrusion includes a post extending from the vertical leg into the hole, thereby mounting the protrusion to the base.

The base preferably includes a pair of horizontally extending protrusions on each side and spaced along the direction of travel. The bottom of the surface of the base includes vertical protuberances adjacent the lateral edges of the bottom surface and extending, in the direction of travel, substantially the length of the pair of protrusions. The bottom surface may also include additional vertical protuberances adjacent the lateral edges of the base and extending in the direction of travel greater than the length of the reflector support surface.

The bottom surface of the base includes a ridge defining a recess and at least one opening is provided through the ridge into the recess. The reflector support surface may also include a wall extending up therefrom and transverses the direction of travel. The wall has a height at least equal to the height of the reflector. Alternatively, the reflector itself may include such a wall.

A method of making a road marker base with a frangible protrusions includes forming a base including reflector support surface. Two openings are formed in opposed surfaces of the base and protrusions, having a bottom surface, are mounted in the openings and extend horizontally from the base. The base and openings may be formed simultaneously, for example, by casting. Alternatively, the openings may be formed by machining the base. The protrusions are preferably bonded in the openings. The protrusions selected to have substantially less than the hardness of the base. A unidirectional base includes a reflector support surface adjacent one end of the base in the direction of travel capable of receiving and providing visibility of both faces of a standard bidirectional reflector.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
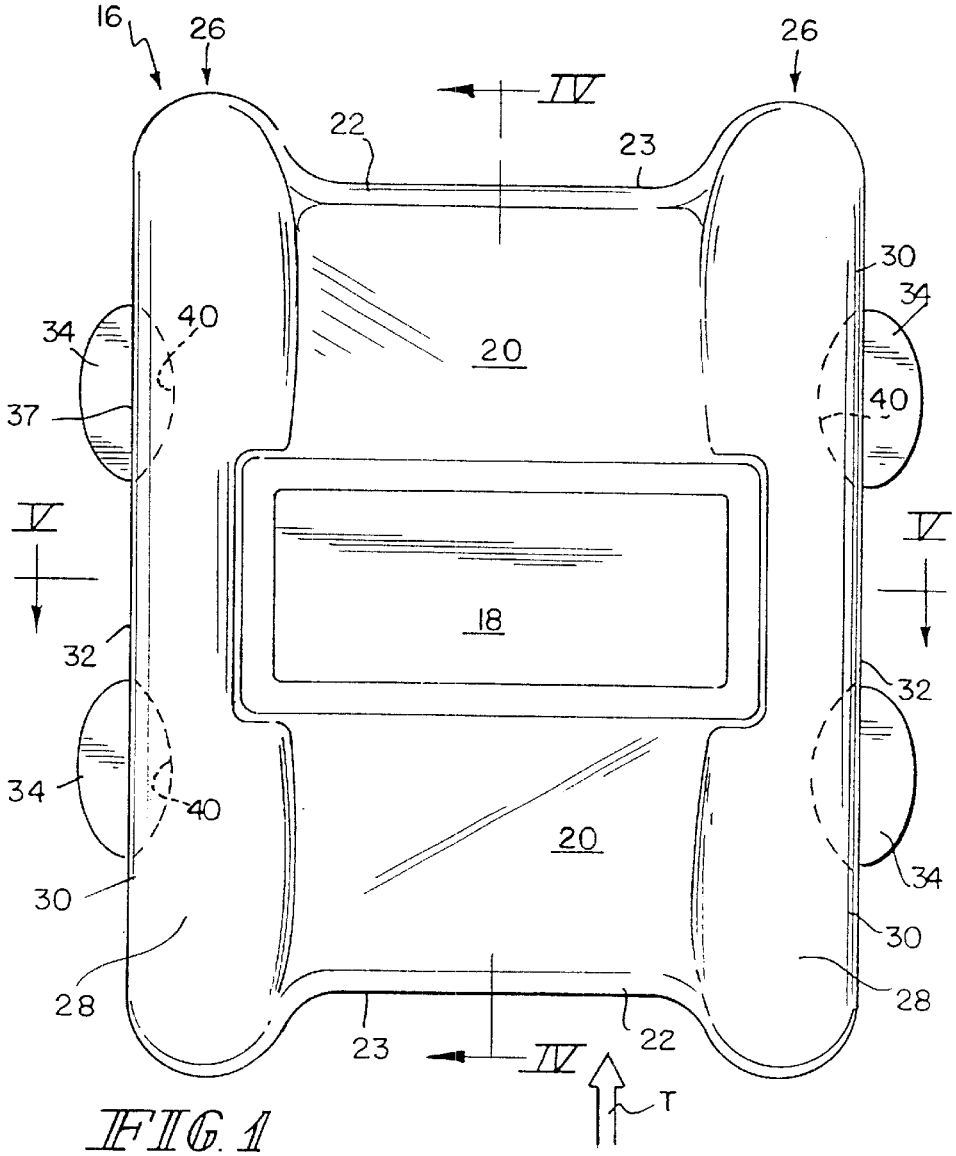
FIG. 1 is a top plan view of a preferred form of a base of a bidirectional road marker according to this invention.
Figure 5:
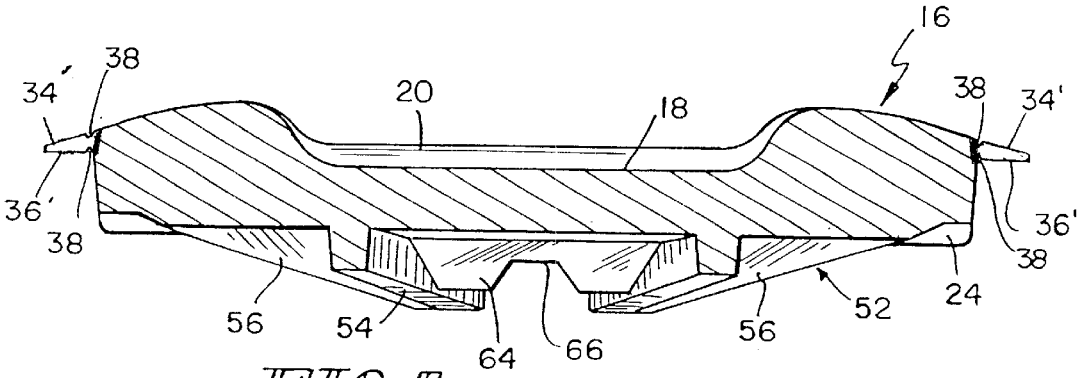
FIG. 5 is a cross sectional view of the second embodiment of the locating protrusions taken along the lines V—V of FIG. 1.
Figure 2:
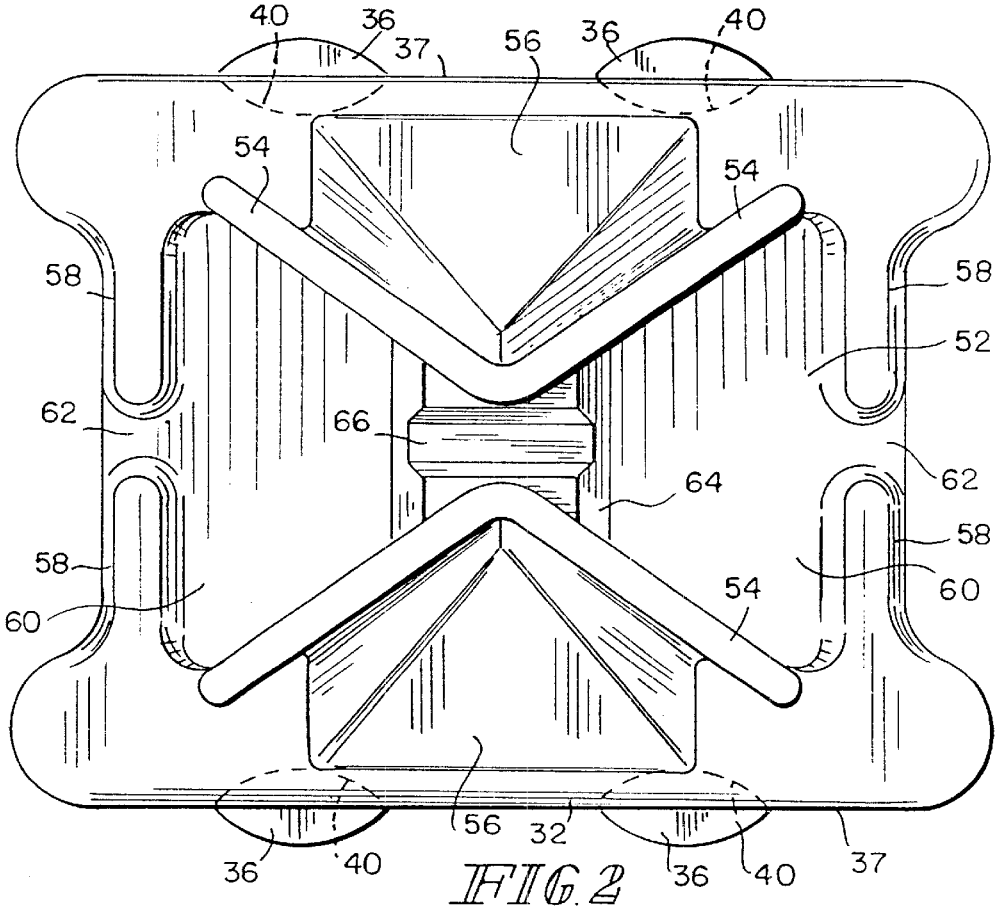
FIG. 2 is a bottom plan view of the base of FIG. 1.

A base 16 for a road marker capable of carrying one or more light sources or reflectors is illustrated in the Drawings. A first embodiment is illustrated in FIGS. 1–4, the second embodiment in FIG. 5 and a third embodiment in FIG. 6. Whereas FIGS. 1–6 is a base designed for a bidirectional road marker, FIGS. 7–10 is a base designed for a unidirectional road marker. The base includes a reflector support surface 18 and a pair of sloping vision ramps 20 extending therefrom in the direction of travel T. The vision ramps 20 terminate in a downwardly expending surface 22, edge 23 and an undercut surface 24. This particular design is for a bidirectional reflector or light source. The principles of the present invention may also be applied to a unidirectional reflector light source and would generally include the reflector support surface 18 and one vision ramp 20 terminating in surfaces 22 and 24 as illustrated in FIGS. 7–10.

Laterally flanking the reflector support surface 18 and the vision ramps 20 are side rail portions 26 of the base 16 having matching generally arcuate upward surfaces 28 which are radiously downwardly at the opposite ends along the direction of travel and cresting adjacent the reflector support surface 18. The surfaces 28 of the rail 26 are flanked along their upward sides by angular downward and sloping side surfaces 30 which terminate at an edge 32.

Figure 3:
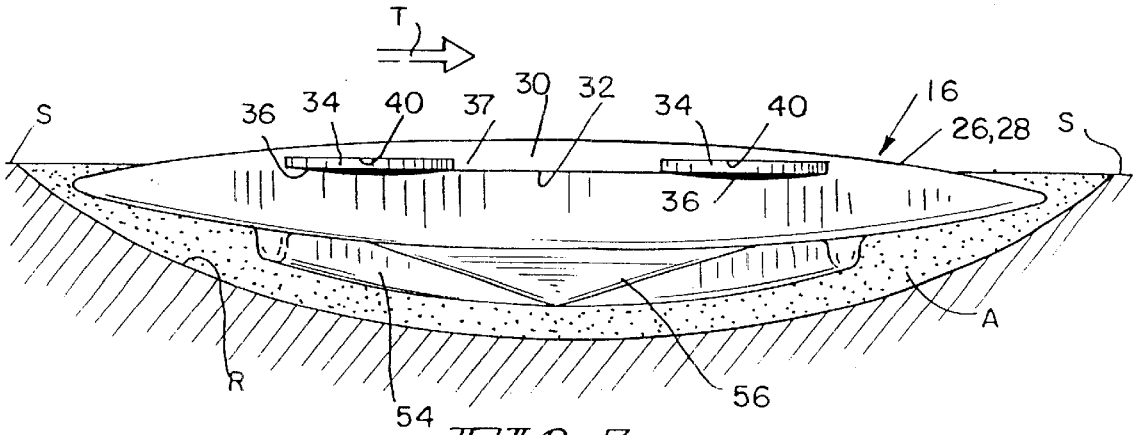
FIG. 3 is a side elevational view of the base of FIG. 1 in its installed position in a roadway.
Figure 4:
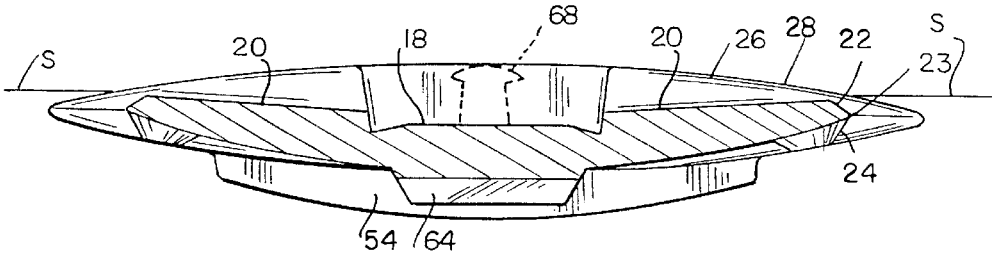
FIG. 4 is a full cross sectional view taken substantially along line IV—IV of FIG. 1.

The base 16 includes a plurality of frangible protrusions 34 extending horizontally therefrom in opposite directions and transverse to the direction of travel T. The protrusions have a bottom surface 36 for engaging the top surface of a road adjacent a recess in the road. The bottom surface also defines the height of the reflector support surface 18 relative to the road top surface. FIG. 3 specifically shows a recess R having the base 16 therein with the bottom surface 36 of the frangible protrusions 34 resting on the road surface S. The base 16 is held in the recess R by adhesives A.

The protrusions 34 are needed only during the period of installation wherein the protrusions 34 set the height of the reflector support surface 18 relative to the road support surface S. Once the adhesive A has hardened, they serve no other purpose and generally have a negative affect during plowing. Snowplows or other objects sliding along the surface have caught the protrusions 34 and broken the seal between the base 16, adhesives A and the recess R. By making the protrusions 34 frangible, they can be broken off after installation, either intentionally or by accidental collision with a snowplow blade.

The base 16 may be made of a material of a first hardness and the protrusions 34 made of a material of second hardness substantially less than the first hardness. For example, the base 16 may be made of metal and the protrusions made of metal of a less hardness or non-metal. A typical example of non-metal is wood or plastic. In that the bases are generally cast iron, there are a substantial number of metals of appropriate thicknesses that are frangible relative to the base 16 for example, aluminum.

Another form of frangibility is to connect the protrusions 34 to the body 16 by a weakened section. This is specifically illustrated in FIG. 5. The protrusion 34' with its undersurface 36' is connected to the base 16 by weakened section 38. In that the base is cast, weakened sections 38 may be part of the casting. Alternatively, the weakened sections 38 can be machined into the final cast product. Thus, the locating protrusions 34 of any prior art base may be machined to provide the weakening section 38 so as to make it frangible relative to the base 16.

In the embodiments of FIGS. 1–4, the protrusions 34 are discs which are received in slots or openings 40 in the surface 37. The discs 34 are bonded in the slots 40 by adhesive. The slots 40 may be formed simultaneously with the base 16, for example, during casting. Depending upon the material, the discs 34 may be cast into the base 16. Alternatively, the slots 40 may be provided by machinery. The preferable material for the protrusions or disc 34 is wood or plastic. For example, it may be a wooden biscuit. Alternatively, it may be a metallic disc, for example, aluminum.

Figure 6:
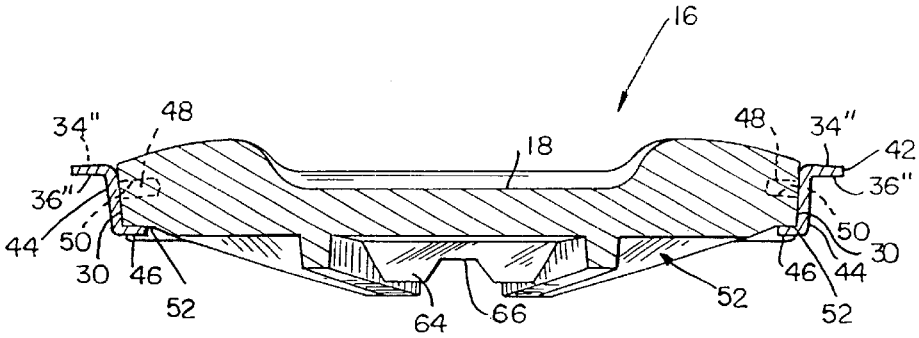
FIG. 6 is a cross sectional view of a third embodiment of the frangible protrusions taken along line V—V of FIG. 1.

A third embodiment of the protrusions 34 is illustrated in FIG. 6. A protrusion 34" includes a horizontal leg 42 whose bottom surface is the road surface engaging surface 36", a vertical leg 44 and a third leg 46 engages the bottom surface 52 of the base 16. A post 48 extends from the vertical leg 44 into a hole or opening 50 in the surface 30 of the base 16. The post 48 is bonded in the hole 50 or may be force fitted. Alternatively, the post may be deleted and the untied leg 44 is bonded to the base 16 at the surface 30 and bottom 52. Though the third leg 46 offers additional stability, it may be deleted if desired.

Although a pair of protrusions 34 shown on each lateral edge, a single large protrusion may be used to position and support the base 16 and the recess R during installation. The protrusion 34" may be made of plastic or metal. By using frangible protrusion 34 of FIGS. 1–4 and 6, the base 16 can be reconditioned and reused economically. The bases 16 can be cleaned in a tumbling abrader. Next, new protrusions can be mounted to the reconditioned base. This was not previously practical.

The ends of sloping surfaces 28 of the rails 26 and the edge 23 of the vision ramps 20 all terminate below the bottom or locating surface 36 of the protrusions 34 and consequently the road surface S. When properly installed, the adhesive A also covers these edges. Thus, the edges of the top surface do not offer easy targets for snowplow plates or other movable objects which would create undesirable forces breaking the seal between the base 16, the adhesive A and the recess R. Also, the ends of the rails 26 and the vision ramps 20 are below the road surfaces and are encased in the adhesive A and offer further resistance to movement along the direction of travel T.

To further increase the resistance of the base 16 to movement within the recess R, the bottom surface 52 has been modified from that shown in U.S. Pat. No. 5,454,664. The bottom surface 52 includes various vertical protuberances. The first are ribs 54 and the second are side webs 56. The ribs 54 extend substantially the length of the pair of protuberances 36 in the direction of travel T. They are substantially V-shaped with their apex being adjacent to each other. The shape offers resistance to movement of the base in either direction of travel T. The webs 56 are semi-pyramidal shaped. Webs 56 also extend a substantial portion of the length of the pair of protrusions 34 in the direction of travel T. At a minimum, webs 56 extend the length of the reflector support surface 18.

Both vertical protuberances 54 and 56 offer resistance to movement of the base 16 in the recess R as well as to disperse the liquid adhesive up over the side surfaces 37 such that the edge 32 is completely encased by the adhesive. When properly designed, they eliminate the need for caulking after the adhesive is set because the adhesive did not appropriately spread past the edge 32 and onto surface 30.

The bottom surface 52 also includes a pair of lateral end ridges 58 forming a recess 60 therebetween with the ribs 54. An opening 62 is provided in each of the ridges 58 to allow the adhesive A to move therethrough to eliminate any air pockets. A center ridge 64 is provided at the apex of the ribs 54 to further narrow the distance between the ribs 54 transverse to the direction of travel T. An opening 66 is provided in the center ridge 64 to allow adhesive A to move within the recess 60. The height of the ridge 64 is less than that of the ribs 54. The ridges 58 and 64 also provide an additional support and resistance to movement in the direction of travel T.

Preferably, a reflector with a center post of metal is used. Alternatively, a wall 68 may be provided, as illustrated in phantom in FIG. 4 on the frangible support surface 18 extending up therefrom and transverse to direction of travel T. The wall 68 at least has the height of the reflector. This provides the protection as described in U.S. Pat. No. 4,454, 664.

FIGS. 7–10 show the base 16 without the protrusions 34''' for a unidirectional marker. The reflector support surface 18 is towards the rear of the base 16. All of the elements having the same function as that in FIGS. 1–6 have the same reference numbers. The support surface 18 is the same size in both embodiments so as to receive a standard bidirectional reflector. This reduces the number of reflectors that must be carried to replace damaged or ejected reflectors. Also, it allows the use and visibility of both faces of a bidirectional reflector in a unidirectional base. The non-travel direction could include a red reflector surface to indicate the wrong direction of travel. By moving the reflector support surface 18 and the reflector further from the leading edge of the base in the direction of travel T, a greater plow angle is achieved without increasing the length of the base in the direction of travel T.

The protrusions 34''' is nota flat disc like 34, but its top surface 35 is an extension of the top surface 28 of the rail. A shoulder 33 is at the exterior juncture of surface 35 and 28. Protrusion 34''' may be used in any other basis of FIGS. 1–6.

Figure 7:
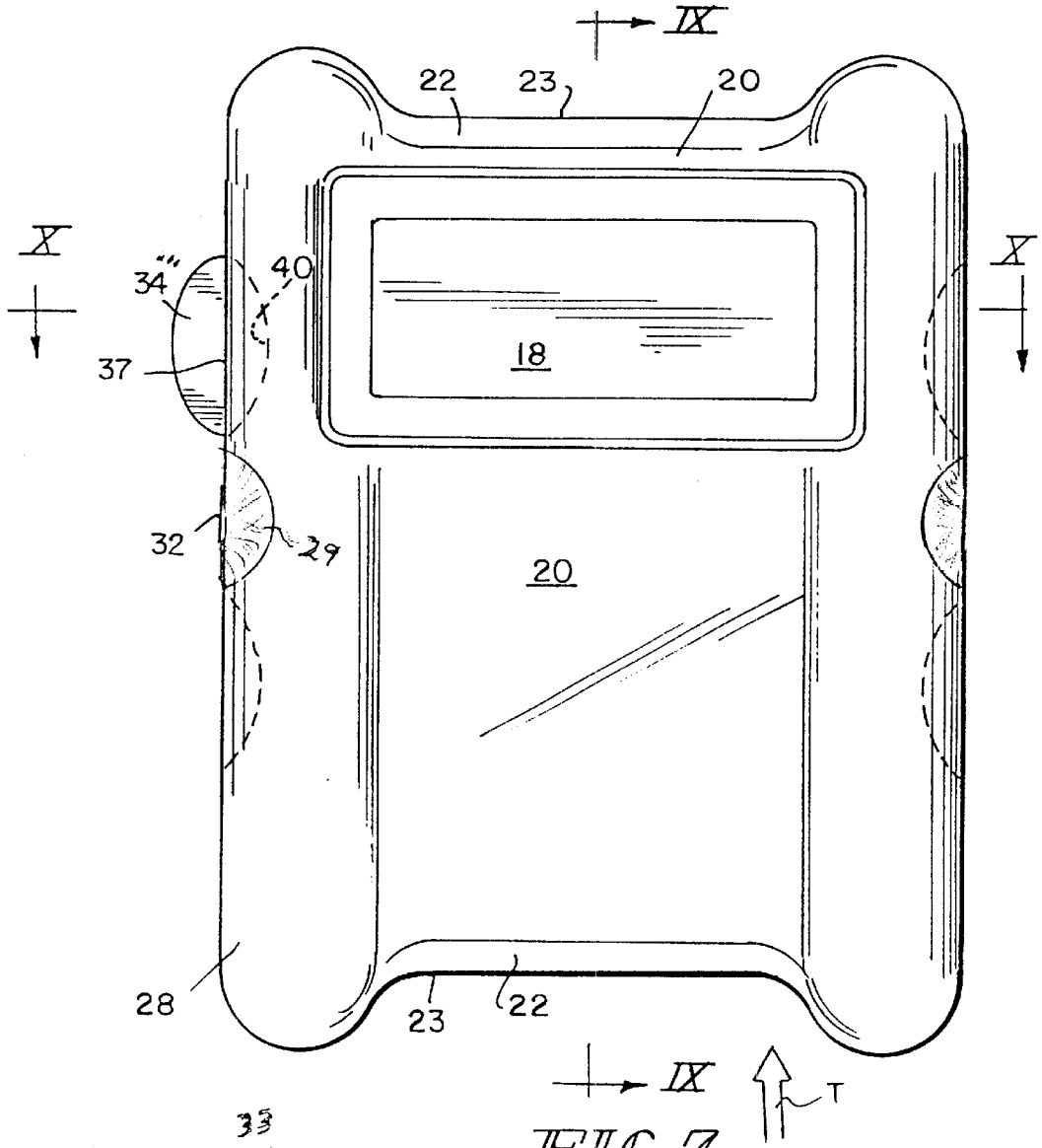
FIG. 7 is a top plan view of a preferred form of a base of a unidirectional road marker according to this invention.
Figure 10:
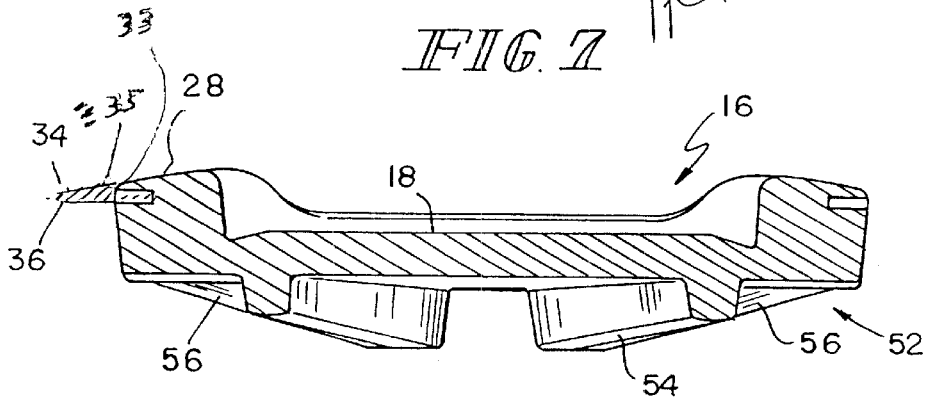
FIG. 10 is a cross sectional view of the second embodiment of the locating protrusions taken along the lines X—X of FIG. 7.
Figure 8:
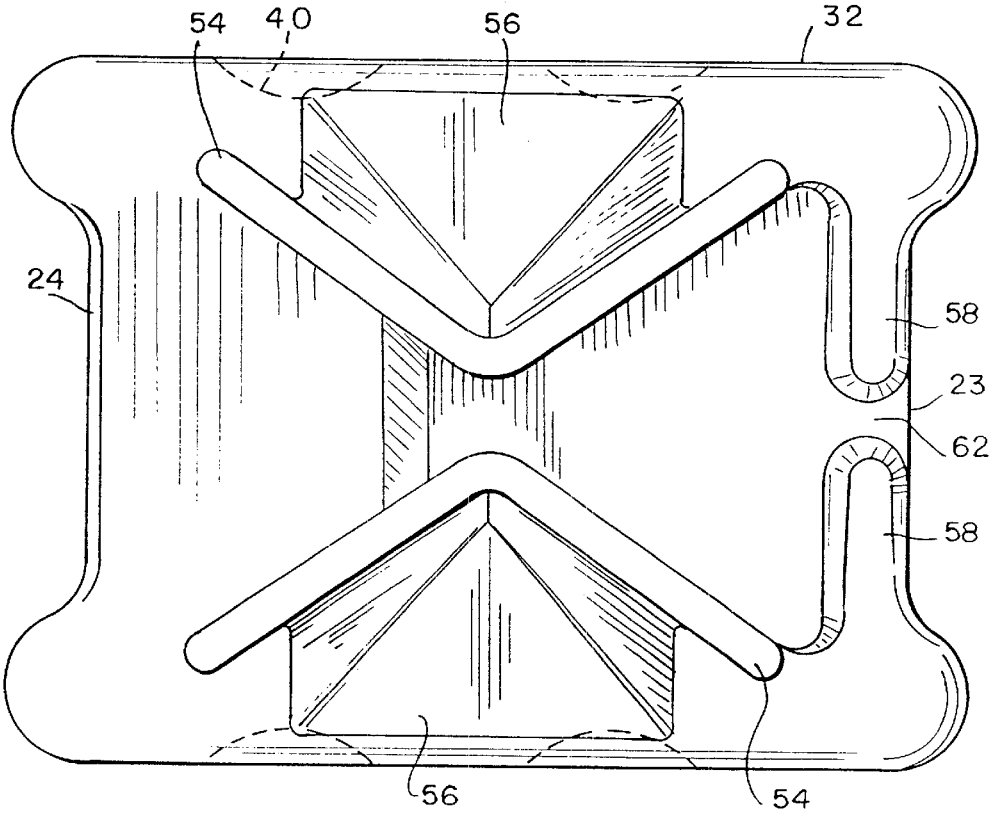
FIG. 8 is a bottom plan view of the base of FIG. 7.
Figure 9:
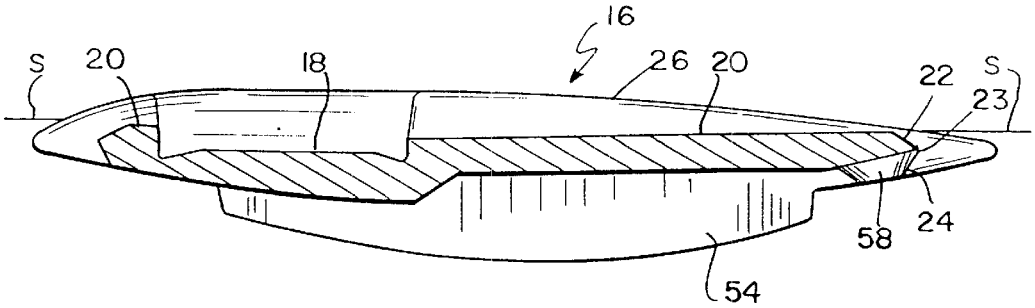
FIG. 9 is a full cross sectional view taken substantially along line IX—IX of FIG. 7.

The base of FIG. 7 also includes an indenture 27 between the protrusions 34''' terminating at edge 32 which coincides with the bottom surface 36 of the protrusions or the road surface S.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A road maker base which supports a reflector, the base comprising:

a bottom surface to be received in a recess in a road;

a reflector support surface to which the reflector is to be mounted;

at least a pair of holes in a side wall of the base;

a pair of protrusions mounted to and extending horizontally from the base in opposite directions and transverse to a direction of travel of the road, and having a bottom surface for engaging a top surface of the road adjacent the recess and defining the height of the reflector support surface relative to the road's top surface;

the protrusions each being an inverted L-shape having a horizontal and a vertical leg;

the vertical leg for extending into the recess and including a post extending from the vertical leg into the hole and mounting the protrusion to the base; and the horizontal leg having the bottom surface for engaging the top surface of the road adjacent the recess.

2. The base according to claim 1, wherein the base is of a first hardness and the protrusions are of a second harness substantially less than the first hardness.

3. The base according to claim 1, wherein the base and the protrusions are metal.

4. The base according to claim 1, wherein the protrusions each include a third leg extending from the vertical leg and engaging the bottom surface of the base.

5. The base according to claim 1, wherein protrusions are bonded to the base.

6. The base according to claim 1, including on each side a pair of horizontally extending protrusions spaced along the direction of travel.

7. The base according to claim 6, wherein the bottom surface of the base includes vertical protuberances adjacent the lateral edges of the bottom surface and extending in the direction of travel between and substantially the length of the pair of protrusions.

8. The base according to claim 1, wherein the bottom surface of the base includes vertical protuberances adjacent the lateral edges of the bottom surface and extending in the direction of travel greater than the length of the reflector support surface.

9. The base according to claim 1, wherein the reflector support surface includes a wall extending up therefrom and transverse to the direction of travel, and the wall has a height at least equal to the height of the reflector.

10. The base according to claim 1, including a reflector mounted to the reflector support surface.

11. The base according to claim 1, wherein the bottom surface of the base includes a ridge defining a recess and an opening through the ridge into the recess.

12. A road maker base which supports a reflector, the base comprising:

a bottom surface to be received in a recess in a road;

a reflector support surface to which the reflector is to be mounted;

a pair of protrusions mounted to and extending horizontally from the base in opposite directions and transverse to a direction of travel of the road, and having a bottom surface for engaging a top surface of the road adjacent the recess and defining the height of the reflector support surface relative to the road's top surface;

the protrusions each having a vertical leg and first and second spaced horizontal legs extending in opposite direction from the vertical leg;

the vertical leg for extending into the recess;

the first horizontal leg having the bottom surface for engaging a top surface of the road adjacent the recess; and the second horizontal leg engaging the bottom surface of the base.

13. The base according to claim 12, wherein protrusions are bonded to the base.

14. The base according to claim 12, wherein the base is of a first hardness and the protrusions are of a second harness substantially less than the first hardness.

15. The base according to claim 12, wherein the base and the protrusions are metal.

* * * * *